US007176939B2

(12) United States Patent
Weitbruch et al.

(10) Patent No.: US 7,176,939 B2
(45) Date of Patent: Feb. 13, 2007

(54) METHOD FOR PROCESSING VIDEO PICTURES FOR FALSE CONTOURS AND DITHERING NOISE COMPENSATION

(75) Inventors: Sébastien Weitbruch, Mönchweiler (DE); Cédric Thebault, Villingen (DE); Carlos Correa, Villingen-Schwenningen (DE)

(73) Assignee: Thomson Licensing, Boulogne-Billancourt (FR)

( * ) Notice: Subject to any disclaimer, the term of this patent is extended or adjusted under 35 U.S.C. 154(b) by 304 days.

(21) Appl. No.: 10/958,514

(22) Filed: Oct. 5, 2004

(65) Prior Publication Data

US 2005/0083343 A1 Apr. 21, 2005

(30) Foreign Application Priority Data

Oct. 7, 2003 (EP) ..... 03292464

(51) Int. Cl.
*G09G 5/00* (2006.01)

(52) U.S. Cl. ..... 345/611

(58) Field of Classification Search ..... 341/131; 345/596, 597, 598, 599, 611, FOR. 156; 348/574; 356/474, 475, 476; 358/3.13–3.19, 358/FOR. 175; 382/264, 269
See application file for complete search history.

(56) References Cited

U.S. PATENT DOCUMENTS 5,598,482 A 1/1997 Balasubramanian
2003/0164961 A1* 9/2003 Daly ..... 358/1.9

FOREIGN PATENT DOCUMENTS

DE EP 0978816 A1 * 2/2000
EP 1 256 924 11/2002
EP 1 262 942 12/2002

* cited by examiner

*Primary Examiner*—Kee M. Tung
*Assistant Examiner*—G. F. Cunningham
(74) *Attorney, Agent, or Firm*—Joseph J. Laks; Harvey D. Fried; Christine Johnson

(57) ABSTRACT

The present invention relates to a method and an apparatus for processing video pictures especially for dynamic false contour effect and dithering noise compensation. The main idea of this invention is to divide the picture to be displayed in areas of at least two types, for example low video gradient areas and high video gradient areas, to allocate a different set of GCC (for Gravity Center Coding) code words to each type of area, the set allocated to a type of area being dedicated to reduce false contours and dithering noise in the area of this type, and to encode the video levels of each area of the picture to be displayed with the allocated set of GCC code words. In this manner, the reduction of false contour effects and dithering noise in the picture is optimized area by area.

12 Claims, 10 Drawing Sheets

METHOD FOR PROCESSING VIDEO PICTURES FOR FALSE CONTOURS AND DITHERING NOISE COMPENSATION

This application claims the benefit, under 35 U.S.C. § 119 of European Patent Application 03292464.9, filed October 7, 2003.

FIELD OF THE INVENTION

The present invention relates to a method and an apparatus for processing video pictures especially for dynamic false contour effect and dithering noise compensation.

BACKGROUND OF THE INVENTION

The plasma display technology now makes it possible to achieve flat colour panels of large size and with limited depth without any viewing angle constraints. The size of the displays may be much larger than the classical CRT picture tubes would have ever allowed.

Plasma Display Panel (or PDP) utilizes a matrix array of discharge cells, which could only be "on" or "off". Therefore, unlike a Cathode Ray Tube display or a Liquid Crystal Display in which gray levels are expressed by analog control of the light emission, a PDP controls gray level by a Pulse Width Modulation of each cell. This time-modulation will be integrated by the eye over a period corresponding to the eye time response. The more often a cell is switched on in a given time frame, the higher is its luminance or brightness. Let us assume that we want to dispose of 8 bit luminance levels i.e 255 levels per colour. In that case, each level can be represented by a combination of 8 bits with the following weights:

1-2-4-8-16-32-64-128

To realize such a coding, the frame period can be divided in 8 lighting sub-periods, called subfields, each corresponding to a bit and a brightness level. The number of light pulses for the bit "2" is the double as for the bit "1"; the number of light pulses for the bit "4" is the double as for the bit "2" and so on . . . . With these 8 sub-periods, it is possible through combination to build the 256 gray levels. The eye of the observers will integrate over a frame period these sub-periods to catch the impression of the right gray level. The FIG. 1 shows such a frame with eight subfields.

The light emission pattern introduces new categories of image-quality degradation corresponding to disturbances of gray levels and colours. These will be defined as "dynamic false contour effect" since it corresponds to disturbances of gray levels and colours in the form of an apparition of coloured edges in the picture when an observation point on the PDP screen moves. Such failures on a picture lead to the impression of strong contours appearing on homogeneous area. The degradation is enhanced when the picture has a smooth gradation, for example like skin, and when the light-emission period exceeds several milliseconds.

When an observation point on the PDP screen moves, the eye will follow this movement. Consequently, it will no more integrate the same cell over a frame (static integration) but it will integrate information coming from different cells located on the movement trajectory and it will mix all these light pulses together, which leads to a faulty signal information.

Basically, the false contour effect occurs when there is a transition from one level to another with a totally different code. The European patent application EP 1 256 924 proposes a code with n subfields which permits to achieve p gray levels, typically p=256, and to select m gray levels, with m<p, among the $2^n$ possible subfields arrangements when working at the encoding or among the p gray levels when working at the video level so that close levels will have close subfields arrangements. The problem is to define what "close codes" means; different definitions can be taken, but most of them will lead to the same results. Otherwise, it is important to keep a maximum of levels in order to keep a good video quality. The minimum of chosen levels should be equal to twice the number of subfields.

As seen previously, the human eye integrates the light emitted by Pulse Width Modulation. So if you consider all video levels encoded with a basic code, the temporal center of gravity of the light generation for a subfield code is not growing with the video level. This is illustrated by the FIG. 2. The temporal center of gravity CG2 of the subfield code corresponding a video level 2 is superior to the temporal center of gravity CG3 of the subfield code corresponding a video level 3 even if 3 is more luminous than 2. This discontinuity in the light emission pattern (growing levels have not growing gravity center) introduces false contour. The center of gravity is defined as the center of gravity of the subfields 'on' weighted by their sustain weight:

$$CG(\text{code}) = \frac{\sum_{i=1}^{n} sfW_i * \delta_i(\text{code}) * sfCG_i}{\sum_{i=1}^{n} sfW_i * \delta_i(\text{code})}$$

where $sfW_i$ is the subfield weight of $i^{th}$ subfield;

$\delta_i$ is equal to 1 if the $i^{th}$ subfield is 'on' for the chosen code, 0 otherwise; and $SfCG_i$ is the center of gravity of the $i^{th}$ subfield, i.e. its time position.

The center of gravity $SfCG_i$ of the seven first subfields of the frame of FIG. 1 are shown in FIG. 3.

So, with this definition, the temporal centers of gravity of the 256 video levels for a 11 subfields code with the following weights, 1 2 3 5 8 12 18 27 41 58 80, can be represented as shown in FIG. 4. As it can be seen, this curve is not monotonous and presents a lot of jumps. These jumps correspond to false contour. The idea of the patent application EP 1 256 924 is to suppress these jumps by selecting only some levels, for which the gravity center will grow smoothly. This can be done by tracing a monotone curve without jumps on the previous graphic, and selecting the nearest point. Such a monotone curve is shown in FIG. 5. It is not possible to select levels with growing gravity center for the low levels because the number of possible levels is low and so, if only growing gravity center levels were selecting, there will not be enough levels to have a good video quality in the black levels since the human eye is very sensitive in the black levels. In addition the false contour in dark area is negligible. In the high level, there is a decrease of the gravity centers. So, there will be a decrease also in the chosen levels, but this is not important since the human eye is not sensitive in the high level. In these areas, the eye is not capable to distinguish different levels and the false contour level is negligible regarding the video level (the eye is only sensitive to relative amplitude if we consider the Weber-Fechner law). For these reasons, the monotony of the curve will be necessary just for the video levels between 10% and 80% of the maximal video level.

In this case, for this example, 40 levels (m=40) will be selected among the 256 possible. These 40 levels permit to keep a good video quality (gray-scale portrayal). This is the selection that can be made when working at the video level, since only few levels, typically 256, are available. But when this selection is made at the encoding, there are $2^n$ different subfield arrangements, and so more levels can be selected as seen on the FIG. 6, where each point corresponds to a subfield arrangement (there are different subfield arrangements giving a same video level).

The main idea of this Gravity Center Coding, called GCC, is to select a certain amount of code words in order to form a good compromise between suppression of false contour effect (very few code words) and suppression of dithering noise (more code words meaning less dithering noise).

The problem is that the whole picture has a different behavior depending on its content. Indeed, in area having smooth gradation like on the skin, it is important to have as many code words as possible to reduce the dithering noise. Furthermore, those areas are mainly based on a continuous gradation of neighboring levels that fits very well to the general concept of GCC as shown on FIG. 7. In this figure, the video level of a skin area is presented. It is easy to see that all levels are near together and could be found easily on the GCC curve presented. The FIG. 8 shows the video level range for Red, Blue and Green mandatory to reproduce the smooth skin gradation on the woman forehead. In this example, the GCC is based on 40 code words. As it can be seen, all levels from one colour component are very near together and this suits very well to the GCC concept. In that case we will have almost no false contour effect in those area with a very good dithering noise behavior if there are enough code words, for example 40.

However, let us analyze now the situation on the border between the forehead and the hairs as presented on the FIG. 9. In that case, we have two smooth areas (skin and hairs) with a strong transition in-between. The case of the two smooth areas is similar to the situation presented before. In that case, we have with GCC almost no false contour effect combined with a good dithering noise behavior since 40 code words are used. The behavior at the transition is quite different. Indeed, the levels required to generate the transition are levels strongly dispersed from the skin level to the hair level. In other words, the levels are no more evolving smoothly but they are jumping quite heavily as shown on the FIG. 10 for the case of the red component.

In the FIG. 10, we can see a jump in the red component from 86 to 53. The levels in-between are not used. In that case, the main idea of the GCC being to limit the change in the gravity center of the light cannot be used directly. Indeed, the levels are too far each other and, in that case, the gravity center concept is no more helpful. In other words, in the area of the transition the false contour becomes perceptible again. Moreover, it should be added that the dithering noise will be also less perceptible in strong gradient areas, which enable to use in those regions less GCC code words more adapted to false contour.

SUMMARY OF THE INVENTION

It is an object of the present invention to disclose a method and a device for processing video pictures enabling to reduce the false contour effects and the dithering noise whatever the content of the pictures.

This is achieved by the solution claimed in independent claims 1 and 10.

The main idea of this invention is to divide the picture to be displayed in areas of at least two types, for example low video gradient areas and high video gradient areas, to allocate a different set of GCC code words to each type of area, the set allocated to a type of area being dedicated to reduce false contours and dithering noise in the area of this type, and to encode the video levels of each area of the picture to be displayed with the allocated set of GCC code words.

In this manner, the reduction of false contour effects and dithering noise in the picture is optimized area by area.

BRIEF DESCRIPTION OF THE DRAWINGS

Exemplary embodiments of the invention are illustrated in the drawings and in more detail in the following description.

In the figures.

DESCRIPTION OF PREFERRED EMBODIMENTS

Figure 1:
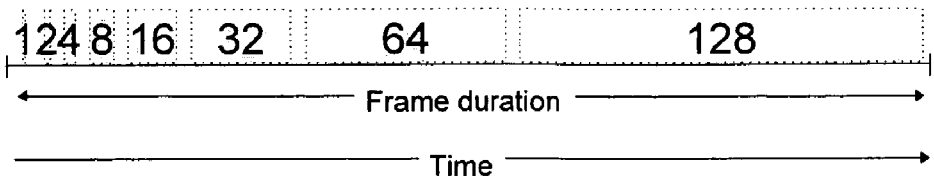
FIG. 1 shows the subfield organization of a video frame comprising 8 subfields.
Figure 2:
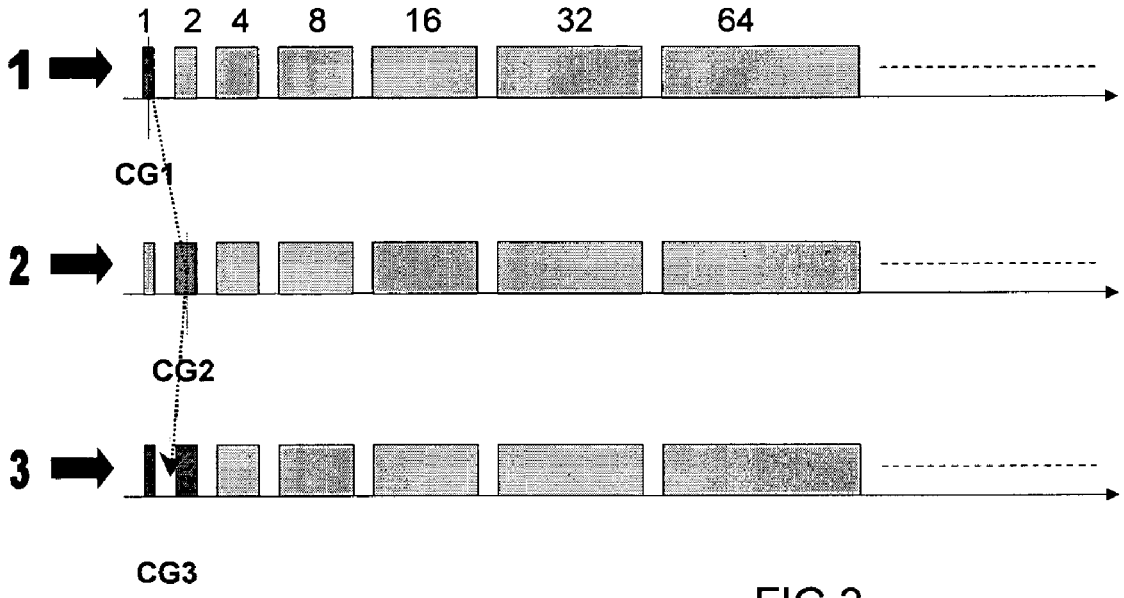
FIG. 2 illustrates the temporal center of gravity of different code words.
Figure 3:
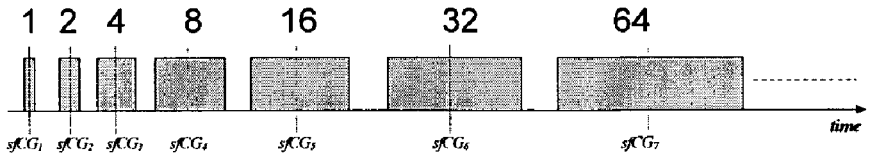
FIG. 3 shows the temporal center of gravity of each subfield in the subfield organization of FIG. 1.
Figure 4:
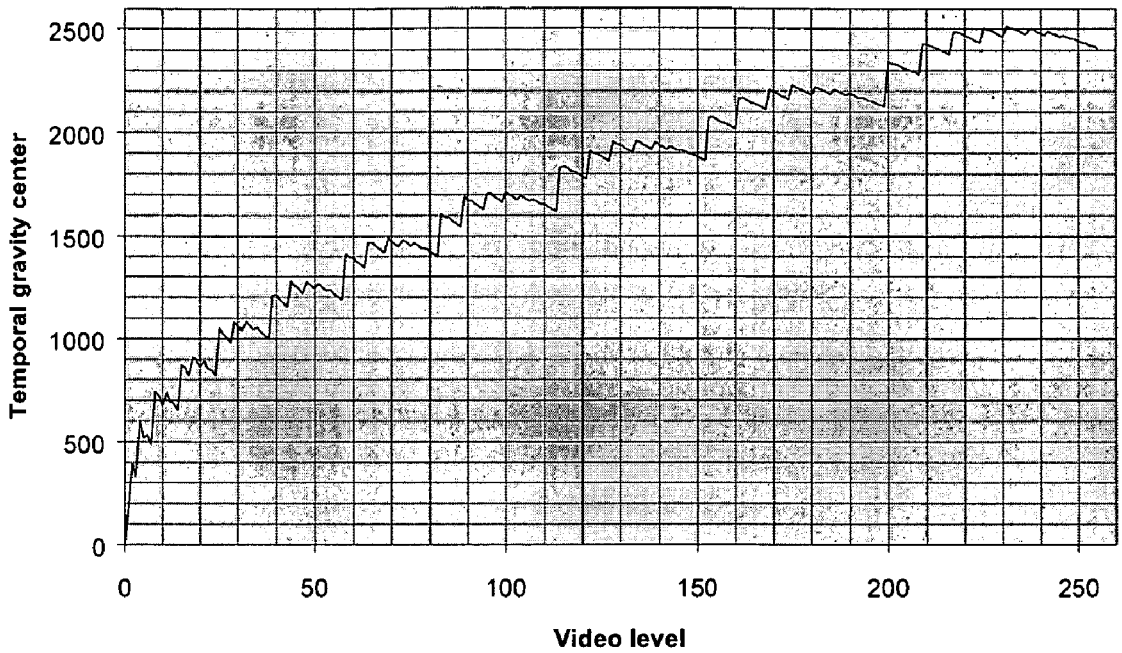
FIG. 4 is a curve showing the temporal centers of gravity of video levels for a 11 subfields coding with the weights 1 2 3 5 8 12 18 27 41 58 80.
Figure 5:
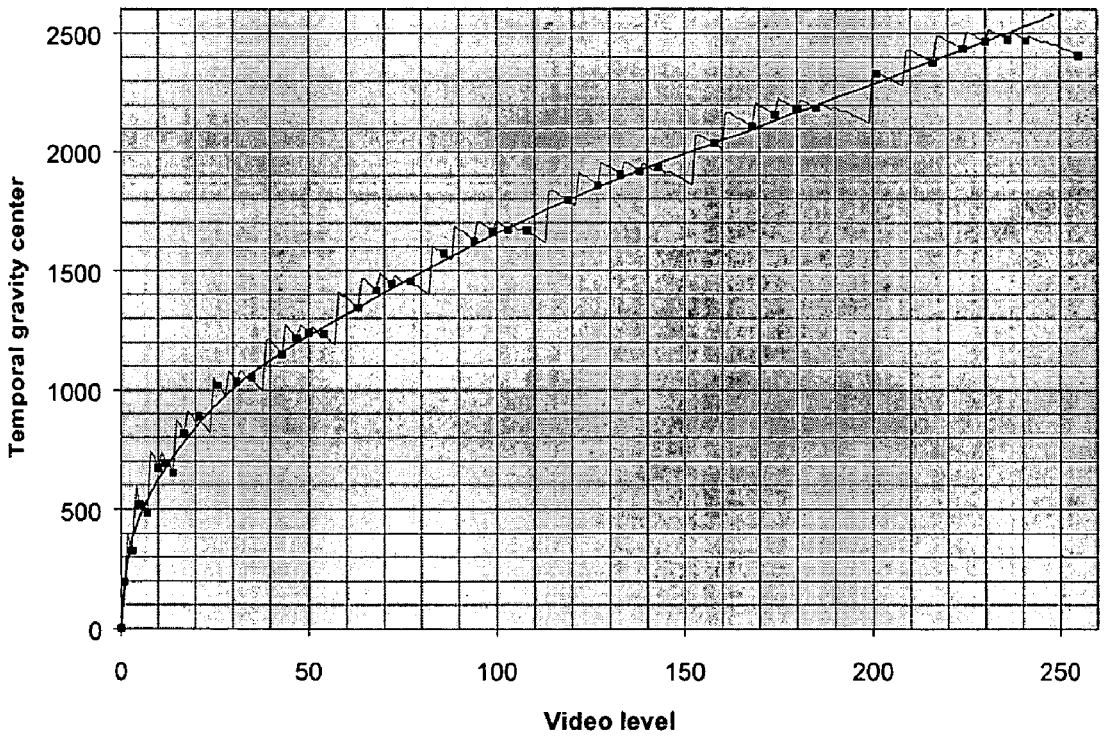
FIG. 5 shows the selection of a set of code words whose temporal centers of gravity grow smoothly with their video level.
Figure 6:
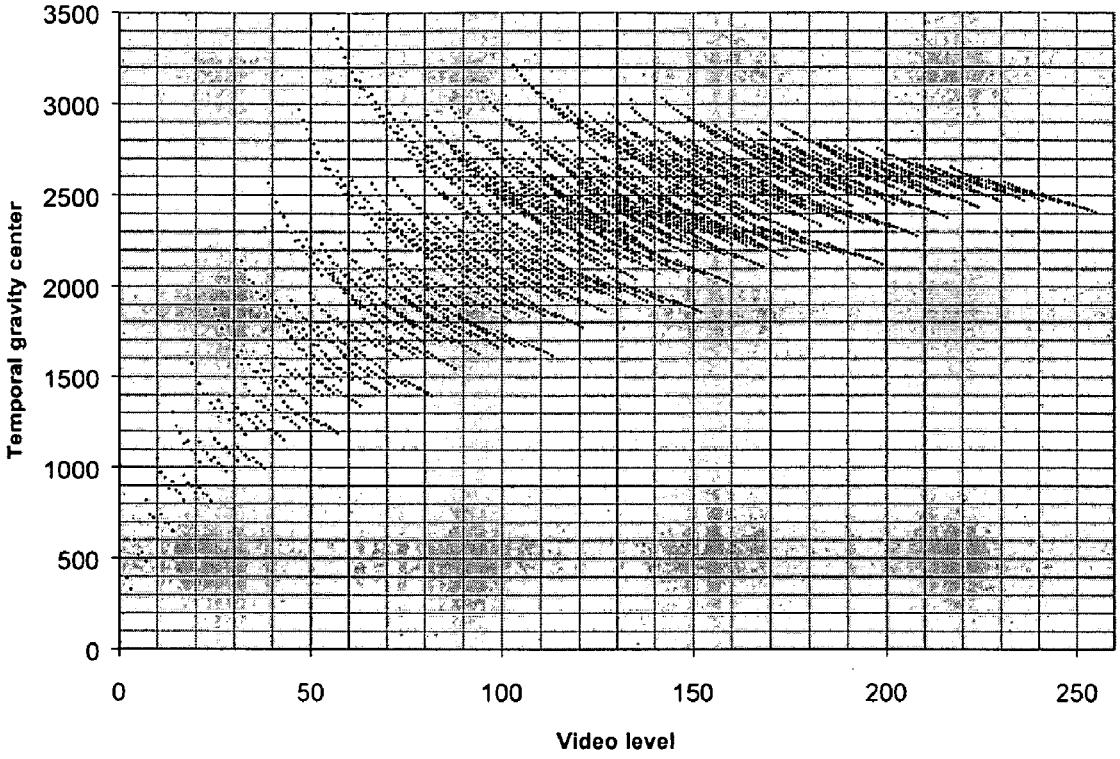
FIG. 6 shows the temporal gravity center of the $2^n$ different subfield arrangements for a frame comprising n subfields.
Figure 8:
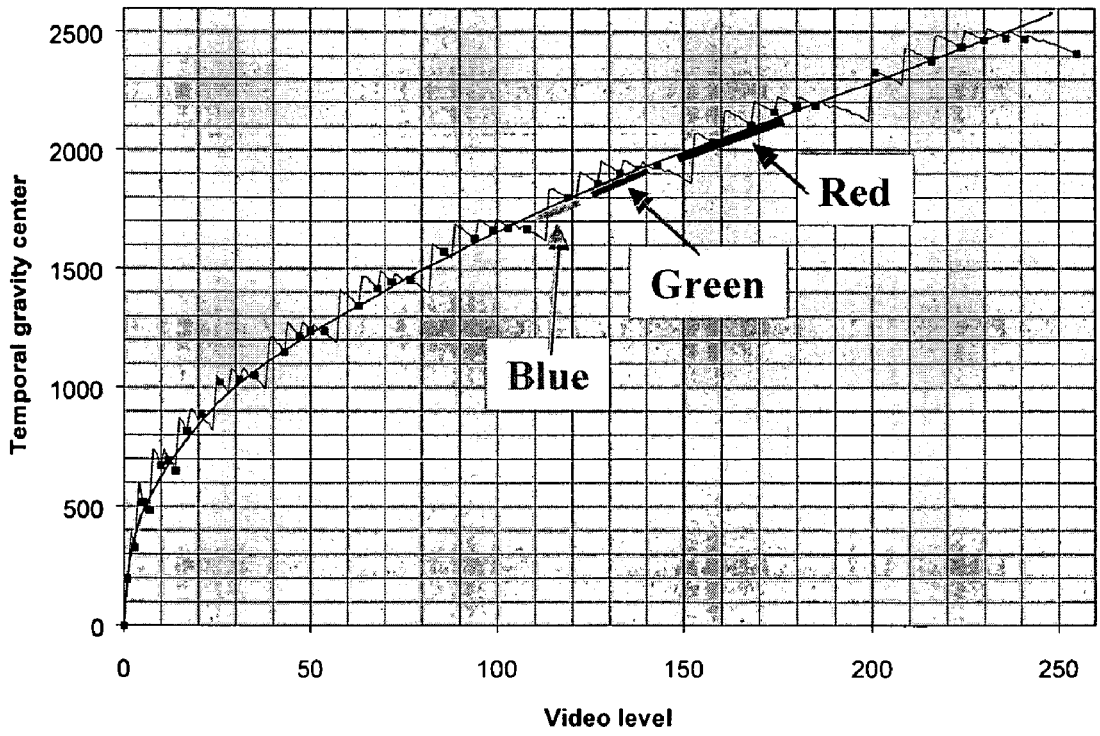
FIG. 8 shows the video level ranges used for reproducing this part of picture.
Figure 7:
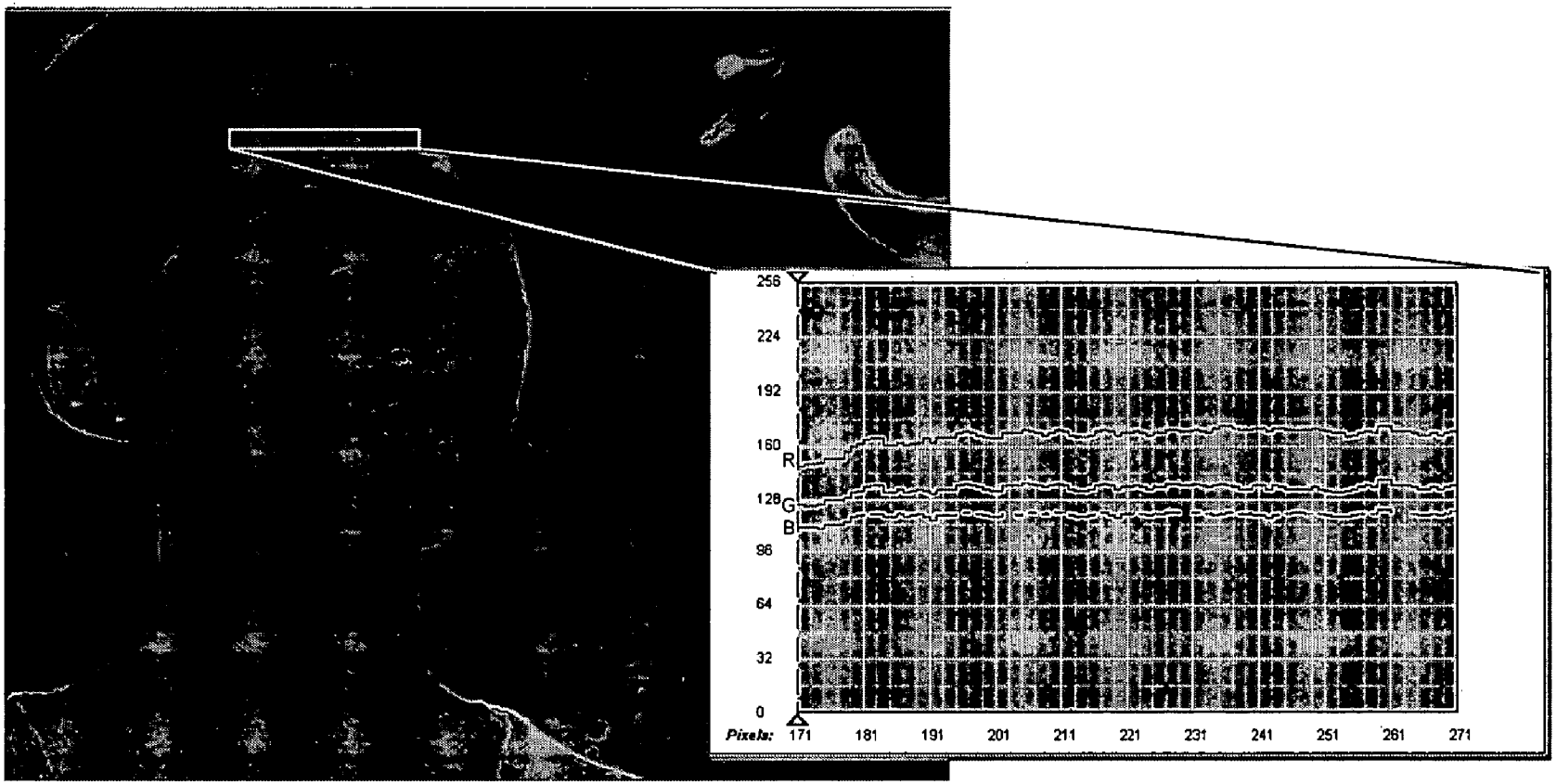
FIG. 7 shows a picture and the video levels of a part of this picture.
Figure 9:
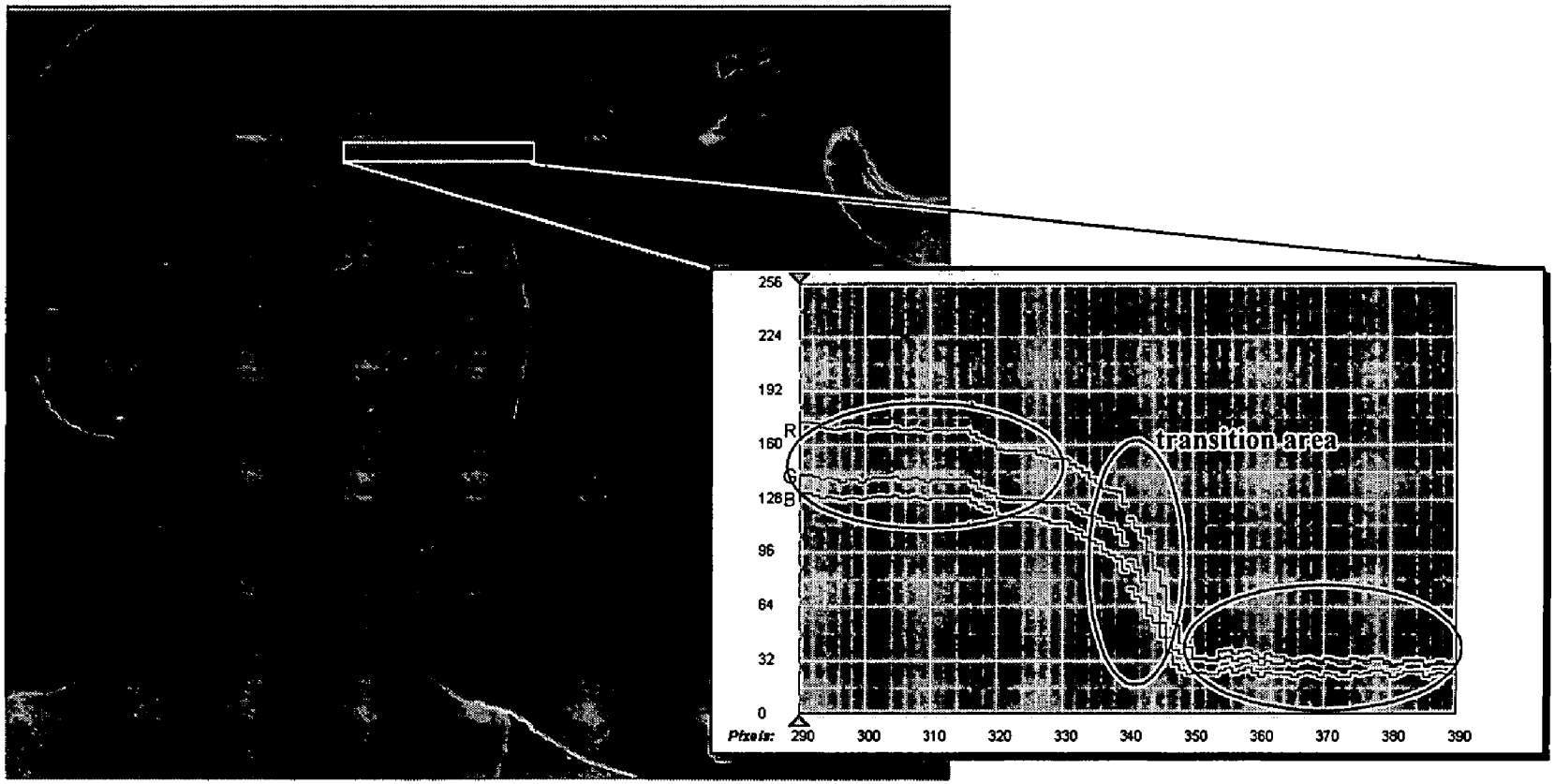
FIG. 9 shows the picture of the FIG. 7 and the video levels of another part of the picture.
Figure 10:
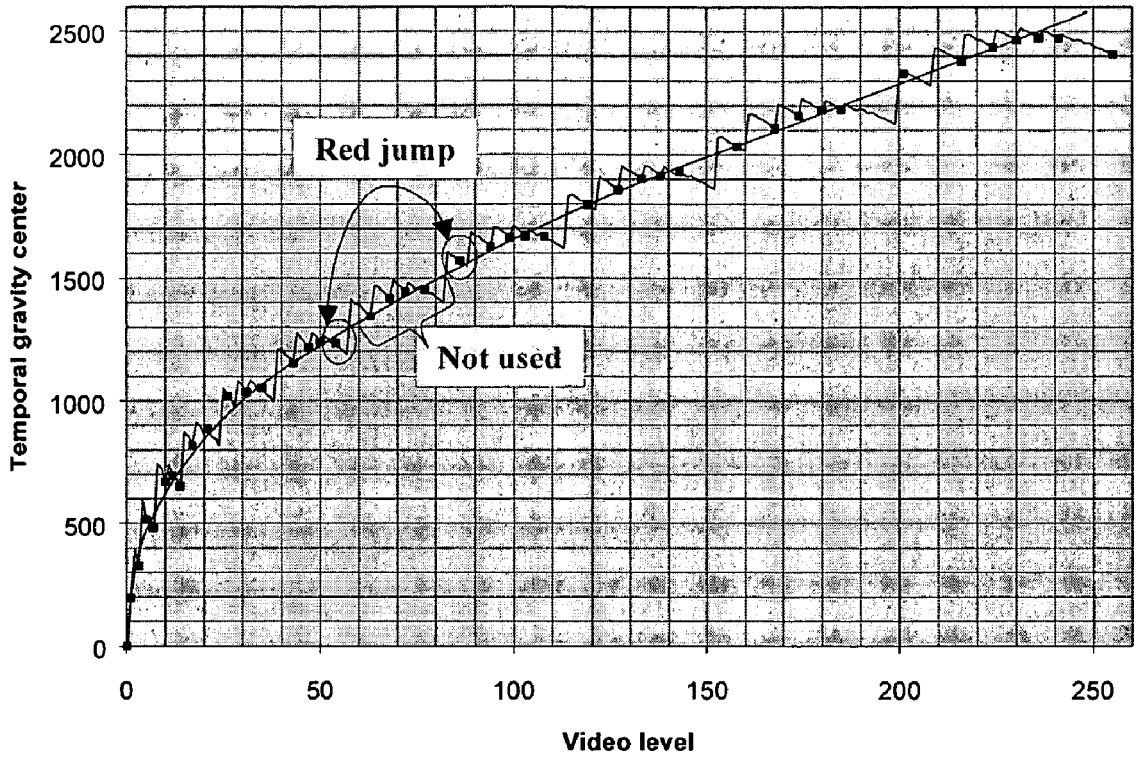
FIG. 10 shows the video level jumps to be carried out for reproducing the part of the picture of FIG. 9.

According to the invention, we use a plurality of sets of GCC code words for coding the picture. A specific set of GCC code words is allocated to each type of area of the picture. For example, a first set is allocated to smooth areas with low video gradient of the picture and a second set is allocated to high video gradient areas of the picture. The values and the number of subfield code words in the sets are chosen to reduce false contours and dithering noise in the corresponding areas.

The first set of GCC code words comprises q different code words corresponding to q different video levels and the second set comprises less code words, for example r code words with $r<q<n$. This second set is preferably a direct subset of the first set in order to make invisible any change between one coding and another.

The first set is chosen to be a good compromise between dithering noise reduction and false contours reduction. The second set, which is a subset of the first set, is chosen to be more robust against false contours.

Two sets are presented below for the example based on a frame with 11 sub-fields: 1 2 3 5 8 12 18 27 41 58 80

The first set, used for low video level gradient areas, comprises for example the 38 following code words. Their value of center of gravity is indicated on the right side of the following table.

| | | | | |
|---|---|---|---|---|
| level | 0 | Coded in 0 0 0 0 0 0 0 0 0 0 0 | Center of gravity | 0 |
| level | 1 | Coded in 1 0 0 0 0 0 0 0 0 0 0 | Center of gravity | 575 |
| level | 2 | Coded in 0 1 0 0 0 0 0 0 0 0 0 | Center of gravity | 1160 |
| level | 4 | Coded in 1 0 1 0 0 0 0 0 0 0 0 | Center of gravity | 1460 |
| level | 5 | Coded in 0 1 1 0 0 0 0 0 0 0 0 | Center of gravity | 1517 |
| level | 8 | Coded in 1 1 0 1 0 0 0 0 0 0 0 | Center of gravity | 1840 |
| level | 9 | Coded in 1 0 1 1 0 0 0 0 0 0 0 | Center of gravity | 1962 |
| level | 14 | Coded in 1 1 1 0 1 0 0 0 0 0 0 | Center of gravity | 2297 |
| level | 16 | Coded in 1 1 0 1 1 0 0 0 0 0 0 | Center of gravity | 2420 |
| level | 17 | Coded in 1 0 1 1 1 0 0 0 0 0 0 | Center of gravity | 2450 |
| level | 23 | Coded in 1 1 1 1 0 1 0 0 0 0 0 | Center of gravity | 2783 |
| level | 26 | Coded in 1 1 1 0 1 1 0 0 0 0 0 | Center of gravity | 2930 |
| level | 28 | Coded in 1 1 0 1 1 1 0 0 0 0 0 | Center of gravity | 2955 |
| level | 37 | Coded in 1 1 1 1 1 0 1 0 0 0 0 | Center of gravity | 3324 |
| level | 41 | Coded in 1 1 1 1 0 1 1 0 0 0 0 | Center of gravity | 3488 |
| level | 44 | Coded in 1 1 1 0 1 1 1 0 0 0 0 | Center of gravity | 3527 |
| level | 45 | Coded in 0 1 0 1 1 1 1 0 0 0 0 | Center of gravity | 3582 |
| level | 58 | Coded in 1 1 1 1 1 1 0 1 0 0 0 | Center of gravity | 3931 |
| level | 64 | Coded in 1 1 1 1 1 0 1 1 0 0 0 | Center of gravity | 4109 |
| level | 68 | Coded in 1 1 1 1 0 1 1 1 0 0 0 | Center of gravity | 4162 |
| level | 70 | Coded in 0 1 1 0 1 1 1 1 0 0 0 | Center of gravity | 4209 |
| level | 90 | Coded in 1 1 1 1 1 1 1 0 1 0 0 | Center of gravity | 4632 |
| level | 99 | Coded in 1 1 1 1 1 1 0 1 1 0 0 | Center of gravity | 4827 |
| level | 105 | Coded in 1 1 1 1 1 0 1 1 1 0 0 | Center of gravity | 4884 |
| level | 109 | Coded in 1 1 1 1 0 1 1 1 1 0 0 | Center of gravity | 4889 |
| level | 111 | Coded in 0 1 1 0 1 1 1 1 1 0 0 | Center of gravity | 4905 |
| level | 134 | Coded in 1 1 1 1 1 1 1 1 0 1 0 | Center of gravity | 5390 |
| level | 148 | Coded in 1 1 1 1 1 1 1 0 1 1 0 | Center of gravity | 5623 |
| level | 157 | Coded in 1 1 1 1 1 1 0 1 1 1 0 | Center of gravity | 5689 |
| level | 163 | Coded in 1 1 1 1 1 0 1 1 1 1 0 | Center of gravity | 5694 |
| level | 166 | Coded in 0 1 1 1 0 1 1 1 1 1 0 | Center of gravity | 5708 |
| level | 197 | Coded in 1 1 1 1 1 1 1 1 1 0 1 | Center of gravity | 6246 |
| level | 214 | Coded in 1 1 1 1 1 1 1 1 0 1 1 | Center of gravity | 6522 |
| level | 228 | Coded in 1 1 1 1 1 1 1 0 1 1 1 | Center of gravity | 6604 |
| level | 237 | Coded in 1 1 1 1 1 1 0 1 1 1 1 | Center of gravity | 6610 |
| level | 242 | Coded in 0 1 1 1 1 0 1 1 1 1 1 | Center of gravity | 6616 |
| level | 244 | Coded in 1 1 0 1 0 1 1 1 1 1 1 | Center of gravity | 6625 |
| level | 255 | Coded in 1 1 1 1 1 1 1 1 1 1 1 | Center of gravity | 6454 |

Figure 11:
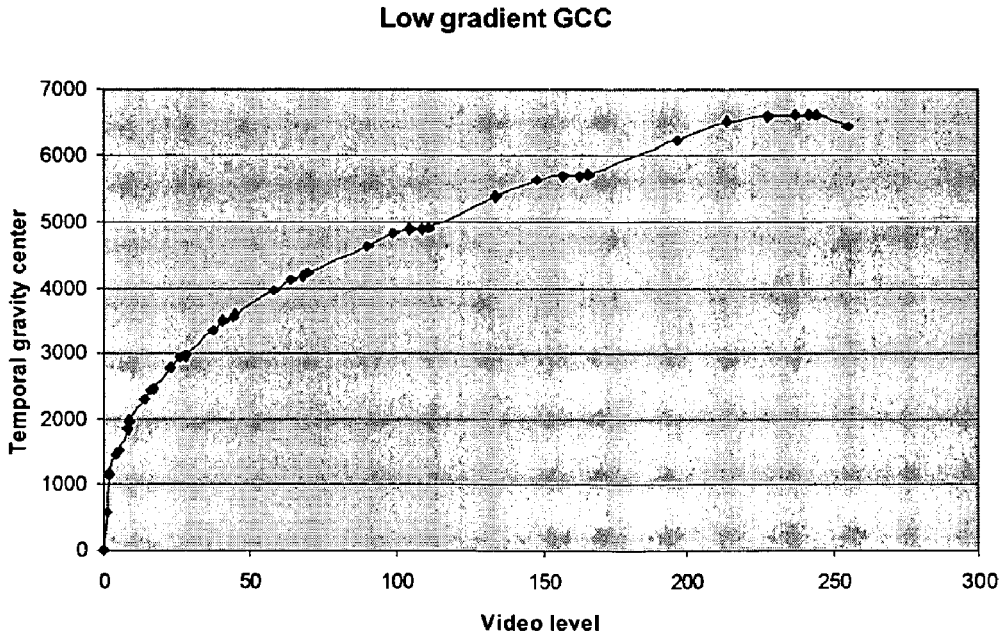
FIG. 11 shows the center of gravity of code words of a first set used for reproducing low gradient areas.

The temporal centers of gravity of these code words are shown on the FIG. 11.

The second set, used for high video level gradient areas, comprises the 11 following code words.

| | | | | |
|---|---|---|---|---|
| level | 0 | Coded in 0 0 0 0 0 0 0 0 0 0 0 | Center of gravity | 0 |
| level | 1 | Coded in 1 0 0 0 0 0 0 0 0 0 0 | Center of gravity | 575 |
| level | 4 | Coded in 1 0 1 0 0 0 0 0 0 0 0 | Center of gravity | 1460 |
| level | 9 | Coded in 1 0 1 1 0 0 0 0 0 0 0 | Center of gravity | 1962 |
| level | 17 | Coded in 1 0 1 1 1 0 0 0 0 0 0 | Center of gravity | 2450 |
| level | 37 | Coded in 1 1 1 1 1 0 1 0 0 0 0 | Center of gravity | 3324 |
| level | 64 | Coded in 1 1 1 1 1 0 1 1 0 0 0 | Center of gravity | 4109 |
| level | 105 | Coded in 1 1 1 1 1 0 1 1 1 0 0 | Center of gravity | 4884 |
| level | 163 | Coded in 1 1 1 1 1 0 1 1 1 1 0 | Center of gravity | 5694 |
| level | 242 | Coded in 0 1 1 1 1 0 1 1 1 1 1 | Center of gravity | 6616 |
| level | 255 | Coded in 1 1 1 1 1 1 1 1 1 1 1 | Center of gravity | 6454 |

Figure 12:
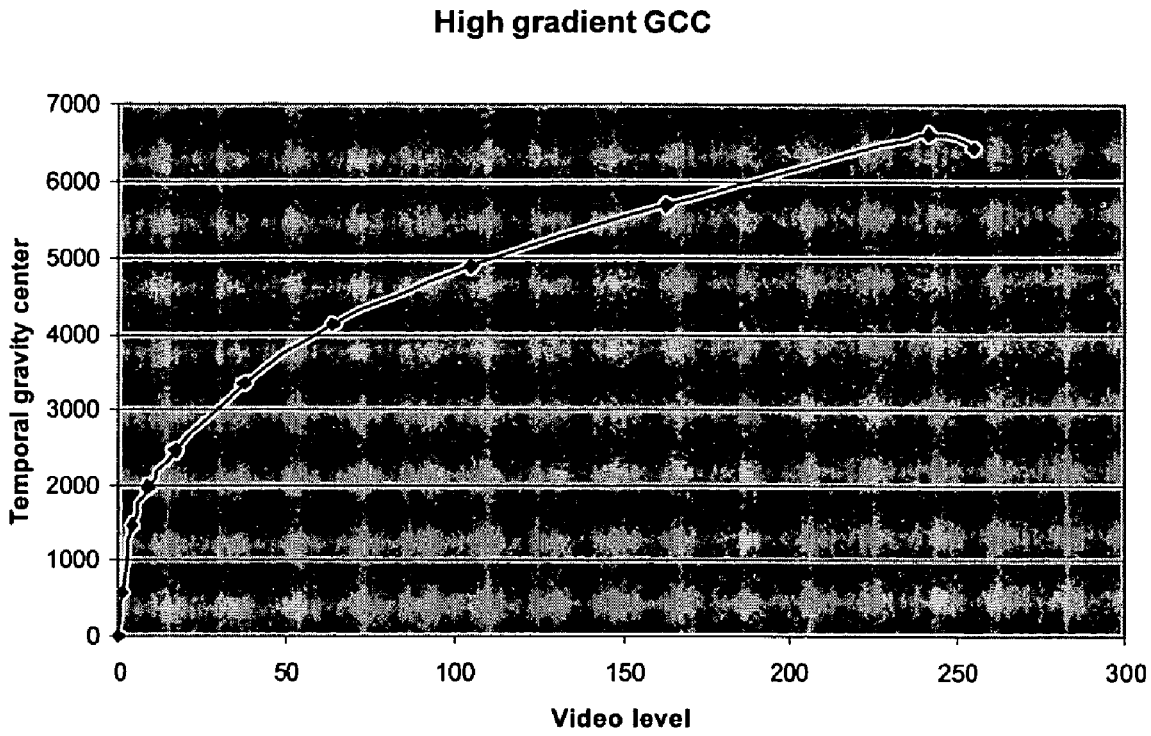
FIG. 12 shows the center of gravity of code words of a second set used for reproducing high gradient areas.

The temporal centers of gravity of these code words are shown on the FIG. 12.

These 11 code words belong to the first set. In the first set, we have kept 11 code words from the 38 of the first set corresponding to a standard GCC approach. However, these 11 code words are based on the same skeleton in terms of bit structure in order to have absolutely no false contour level.

Let us comment this selection:

| | | | | |
|---|---|---|---|---|
| level | 0 | Coded in 0 0 0 0 0 0 0 0 0 0 0 | Center of gravity | 0 |
| level | 1 | Coded in 1 0 0 0 0 0 0 0 0 0 0 | Center of gravity | 575 |
| level | 4 | Coded in 1 0 1 0 0 0 0 0 0 0 0 | Center of gravity | 1460 |
| level | 9 | Coded in 1 0 1 1 0 0 0 0 0 0 0 | Center of gravity | 1962 |
| level | 17 | Coded in 1 0 1 1 1 0 0 0 0 0 0 | Center of gravity | 2450 |

Levels 1 and 4 will introduce no false contour between them since the code 1 (1 0 0 0 0 0 0 0 0 0 0) is included in the code 4 (1 0 1 0 0 0 0 0 0 0 0). It is also true for levels 1 and 9 and levels 1 and 17 since both 9 and 17 are starting with 1 0. It is also true for levels 4 and 9 and levels 4 and 17 since both 9 and 17 are starting with 1 0 1, which represents the level 4. In fact, if we compare all these levels 1, 4, 9 and 17, we can observe that they will introduce absolutely no false contour between them. Indeed, if a level M is bigger than level N, then the first bits of level N up to the last bit to 1 of the code of the level N are included in level M as they are.

This rule is also true for levels 37 to 163. The first time this rule is contravened is between the group of levels 1 to 17 and the group of levels 37 to 163. Indeed, in the first group, the second bit is 0 whereas it is 1 in the second group. Then, in case of a transition 17 to 37, a false contour effect of a value 2 (corresponding to the second bit) will appear. This is negligible compared to the amplitude of 37.

It is the same for the transition between the second group (37 to 163) and 242 where the first bit is different and between 242 and 255 where the first and sixth bits are different.

Figure 13:
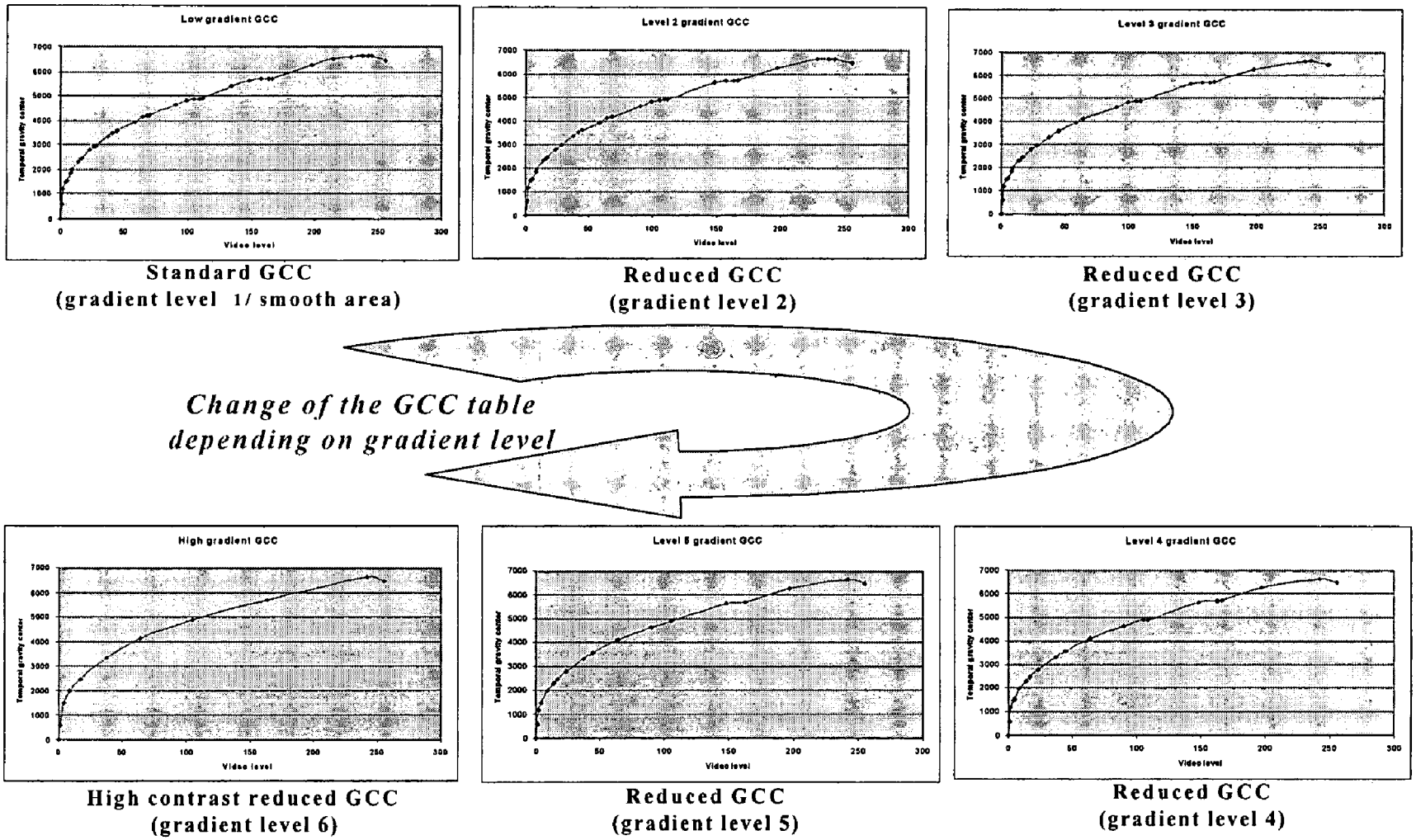
FIG. 13 shows a plurality of possible sets of code words selected according the gradient of the area of picture to be displayed.

The two sets presented below are two extreme cases, one for the ideal case of smooth area and one for a very strong transition with high video gradient. But it is possible to define more than 2 subsets of GCC coding depending on the gradient level of the picture to be displayed as shown on FIG. 13. In this example, 6 different subsets of GCC code words are defined which are going from standard approach (level 1) for low gradient up to a strongly reduced code word set for very high contrast (level 6). Each time the gradient level is increased, the number of GCC code words is decreased and in this example, it goes from 40 (level 1) to 11 (level 6).

Besides the definition of the set and subsets of GCC code words, the main idea of the concept is to analyze the video gradient around the current pixel in order to be able to select the appropriate encoding approach.

Below, you can find a standard filter approaches in order to extract current video gradient values:

$$\begin{vmatrix} 1 & 1 & 1 \\ 1 & -8 & 1 \\ 1 & 1 & 1 \end{vmatrix} \text{ or } \begin{vmatrix} -1 & 2 & -1 \\ 2 & -4 & 2 \\ -1 & 2 & -1 \end{vmatrix} \text{ or } \begin{vmatrix} -1 & -1 & -1 & -1 & -1 \\ -1 & 1 & 2 & 1 & -1 \\ -1 & 2 & 4 & 2 & -1 \\ -1 & 1 & 2 & 1 & -1 \\ -1 & -1 & -1 & -1 & -1 \end{vmatrix}$$

Figure 14:
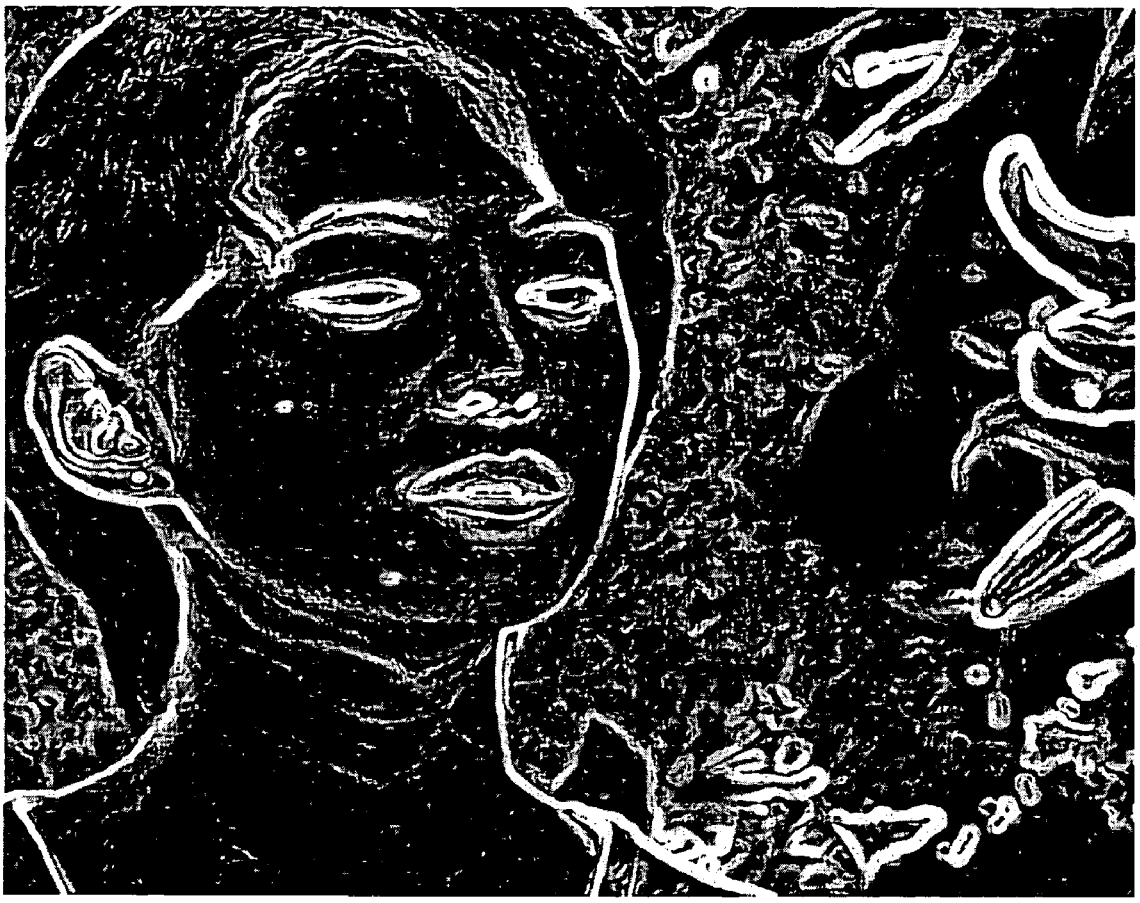
FIG. 14 shows the result of gradient extraction in a picture.

The three filters presented above are only example of gradient extraction. The result of such a gradient extraction is shown on the FIG. 14. Black areas represent region with low gradient. In those regions, a standard GCC approach can be used e.g. the set of 38 code words in our example. On the other hand, luminous areas will correspond to region where reduced GCC code words sets should be used. A subset of code words is associated to each video gradient range. In our example, we have defined 6 non-overlapping video gradient ranges.

Many other types of filters can be used. The main idea in our concept is only to extract the value of the local gradient in order to decide which set of code words should be used for encoding the video level of the pixel.

Horizontal gradients are more critical since there are much more horizontal movement than vertical in video sequence. Therefore, it is useful to use gradient extraction filters that have been increased in the horizontal direction. Such filters are still quite cheap in terms of on-chip requirements since only vertical coefficient are expensive (requires line memories). An example of such an extended filter is presented below:

$$\begin{vmatrix} -2 & -1 & 1 & 2 & 4 & 2 & 1 & -1 & -2 \\ -2 & -1 & 2 & 4 & 8 & 4 & 2 & -1 & -2 \\ -2 & -1 & 1 & 2 & 4 & 2 & 1 & -1 & -2 \end{vmatrix}$$

In that case, we will define gradient limits for each coding set so that, if the gradient of the current pixel is inside a certain range, the appropriate encoding set will be used.

Figure 15:
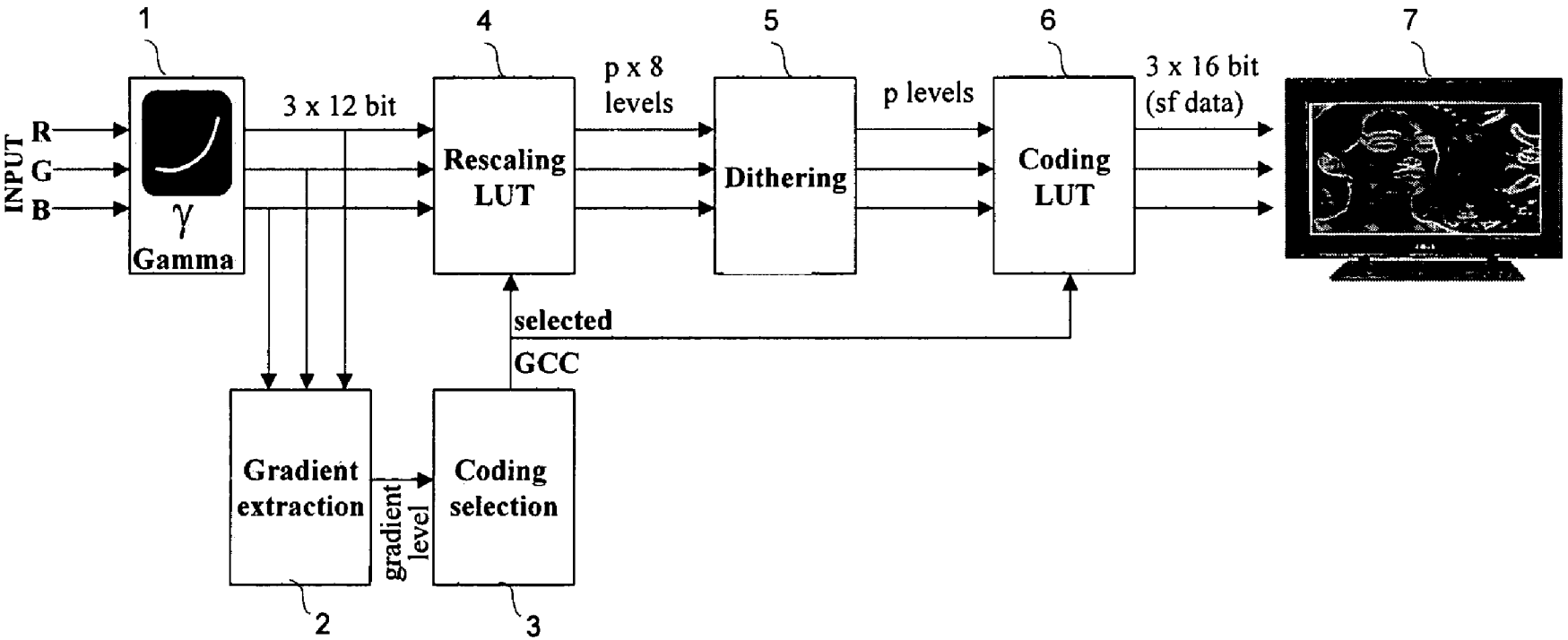
FIG. 15, shows a functional diagram of a device according to the invention.

A device implementing the invention is presented on FIG. 15. The input R, G, B picture is forwarded to a gamma block 1 performing a quadratic function under the form $$\text{Out} = 4095 \times \left(\frac{\text{Input}}{\text{MAX}}\right)^{\gamma}$$

where $\gamma$ is more or less around 2.2 and MAX represents the highest possible input value. The output signal of this block is preferably more than 12 bits to be able to render correctly low video levels. It is forwarded to a gradient extraction block 2, which is one of the filters presented before. In theory, it is also possible to perform the gradient extraction before the gamma correction. The gradient extraction itself can be simplified by using only the Most Significant Bits (MSB) of the incoming signal (e.g. 6 highest bits). The extracted gradient level is sent to a coding selection block 3, which selects the appropriate GCC coding set to be used. Based on this selected mode, a resealing LUT 4 and a coding LUT 6 are updated. Between them, a dithering block 7 adds more than 4 bits dithering to correctly render the video signal. It should be noticed that the output of the resealing block 4 is p×8 bits where p represents the total amount of GCC code words used (from 40 to 11 in our example). The 8 additional bits are used for dithering purposes in order to have only p levels after dithering for the encoding block.

What is claimed is:

1. Method for processing video pictures especially for dynamic false contour effect and dithering noise compensation, each of the video pictures consisting of pixels having at least one colour component, the colour component values being digitally coded with a digital code word, hereinafter called subfield code word, wherein to each bit of a subfield code word a certain duration is assigned, hereinafter called subfield, during which a colour component of the pixel can be activated for light generation, wherein it comprises the following steps:

dividing each of the video pictures into areas of at least two types according to the video gradient of the picture, a specific video gradient range being allocated to each type of area, determining, for each type of area, a specific set of subfield code words dedicated to reduce the false contour effects and/or the dithering noise in the areas of said type, encoding the pixels of each area of the picture with the corresponding set of subfield code words.

2. Method according to claim 1, wherein, in each set of subfield code words, the temporal centre of gravity for the light generation of the subfield code words grows continuously with the corresponding video level except for the low video level range up to a first predefined limit and/or in the high video level range from a second predefined limit.

3. Method according to claim 2, wherein the video gradient ranges are non-overlapping and that the number of codes in the sets of subfield code words decreases as the average gradient of the corresponding video gradient range gets higher.

4. Method according to claim 3, wherein a first set is defined for the video gradient range with the highest gradient values and that the other sets are subsets of this first set.

5. Method according to claim 4, wherein the set defined for a specific video gradient range is a subset of the set defined for the neighboring video gradient range with lower gradients values.

6. Method according to claim 2, wherein the subfield code words of the set allocated to the video gradient range with the highest video gradient are determined in such a way that, in at least one subset of consecutive video levels of said set, the subfield code word of a video level includes at least the bits to "1" of the subfield code word of the neighboring lower video level in the set.

7. Method according to claim 6, wherein, for dividing the video picture into areas according to the video gradient of picture, the picture is filtered by a gradient extraction filter.

8. Method according to claim 7, wherein the gradient extraction filter is a horizontal filter.

9. Method according to claim 2, wherein the first predefined limit is substantially 10% of the maximum video level and/or the second predefined limit is substantially 80% of the maximum video level.

10. Apparatus for processing video pictures especially for dynamic false contour effect compensation, each of the video pictures consisting of pixels having at least one colour component, comprising:

first means for digitally coding the at least one colour component values with a digital code word, hereinafter called subfield code word, wherein to each bit of a subfield code word a certain duration is assigned, hereinafter called subfield, during which a colour component of the pixel can be activated for light generation, wherein it further comprises:

a gradient extraction block for breaking down each of the video pictures into areas of at least two types according to the video gradient of the picture, a specific video gradient range being allocated to each type of area, second means for selecting among the p possible subfield code words for the at least one colour component, for each type $T_i$ of area, i being an integer, a set $S_i$ of $m_i$ subfield code words for encoding the at least one colour component of the areas of this type, each set Si being dedicated to reduce the false contour effects and/or the dithering noise in the corresponding areas, and third means for coding the different areas of each video picture with the associated subfield cod words set.

11. Apparatus according to claim 10, wherein the first means comprises a dithering block, in which dithering values are added to the code words of the video picture for the at least one colour component in order to increase the grey scale portrayal.

12. Apparatus according to claim 10, wherein the first means comprises a degamma block in which the input video levels of the picture are amplified to compensate for the gamma correction in the video source.

* * * * *